United States Patent [19]

Billing

[11] Patent Number: 4,489,456

[45] Date of Patent: Dec. 25, 1984

[54] TOOL FOR MAKING RIVET OR EXPANSION NAILS

[76] Inventor: Lars J. T. Billing, Vermlandsgatan 2, Helsingborg, Sweden

[21] Appl. No.: 422,902

[22] PCT Filed: Dec. 18, 1981

[86] PCT No.: PCT/SE81/00382

§ 371 Date: Sep. 10, 1982

§ 102(e) Date: Sep. 10, 1982

[87] PCT Pub. No.: WO82/02504

PCT Pub. Date: Aug. 5, 1982

[30] Foreign Application Priority Data

Jan. 23, 1981 [SE] Sweden ..... 8100395

[51] Int. Cl.[3] ..... B21G 3/08; B21G 3/18; B21G 3/24

[52] U.S. Cl. ..... 10/43

[58] Field of Search ..... 10/28, 30, 31, 34–36, 10/40, 43–45, 47–51, 53, 57, 58, 61, 70; 83/128

[56] References Cited

U.S. PATENT DOCUMENTS

| | | | |
|---|---|---|---|
| 465,960 | 12/1891 | Yoch | 10/31 |
| 701,178 | 5/1902 | Dussault | 10/45 |
| 2,329,744 | 9/1943 | Clarke | 10/34 X |
| 3,254,550 | 6/1966 | McDonald | 83/128 |
| 3,728,888 | 4/1973 | Motzer | 10/31 X |

FOREIGN PATENT DOCUMENTS

| | | | |
|---|---|---|---|
| 227170 | 11/1907 | Fed. Rep. of Germany . | |
| 581804 | 5/1924 | France | 10/43 |
| 2150103 | 3/1973 | France . | |
| 39110 | 9/1936 | Netherlands | 10/43 |
| 69590 | 7/1915 | Switzerland | 10/43 |
| 8614 | of 1888 | United Kingdom | 10/43 |

*Primary Examiner*—E. Michael Combs

*Attorney, Agent, or Firm*—Fleit, Jacobson, Cohn & Price

[57] ABSTRACT

A tool for making a rivet or expansion nail, i.e. a nail that has at least at one end a laterally expandable portion and is made by cutting off and stamping a nail wire in a single working stroke, wherein the tool includes a guide for a nail wire for guiding the wire in a plane perpendicular to the wire, a cutter having edges disposed in V-fashion, a stamping mandrel arranged in the plane of symmetry of the cutting edges and positioned on the open side of and facing away from the converging point of the V-arrayed cutting edges, and resilient applicators which are pressed by the nail wire during a working stroke of the tool against the action of a spring and lift the nail from the cutter and stamping mandrel during a return stroke of the tool.

10 Claims, 8 Drawing Figures

TOOL FOR MAKING RIVET OR EXPANSION NAILS

The present invention relates to a tool for making so-called rivet nails or expansion nails, i.e. a nail that has at least at one end a laterally expandible portion. The nail is made by cutting off and stamping a nail wire.

Various tools have been designed for the manufacture of rivet nails but they have not proved able to attain the high speeds required for a rational production, i.e. at least about 200 nails per minute. This depends int. al. on the fact that the nails get stuck in the tool or are difficult to remove rapidly from the tool since that part of the tool which makes the expandible portion of the nail by stamping tends to retain the nail in the tool.

Complicated and expensive tools, including a plurality of mobile components, have been built in order to solve this problem. However, these tools have not been able to attain the high production rate necessary for an econimical manufacture of rivet or expansion nails.

The object of the present invention is to overcome the above-mentioned disadvantages and to produce a tool which can be run at a high production rate without functional disorder due to the fact that it will be very simple although it produces one completely finished expansion nail per working stroke. The manufacture also takes place without wastage of material, thus eliminating the problems of collecting and removing wastage as well as the costs entailed therewith. Thanks to the simplicity of the tool it will also become amazingly cheap.

This object is realised by the tool according to the invention which effects cutting off the point of the nail and stamping the expandible portion of the nail during a single working stroke because the tool comprises a guide for the nail wire for guiding the wire in a plane perpendicular to the wire, a cutting-off means having cutting edges disposed in V-fashion, a stamping means arranged in the symmetry plane of said V-shaped cutting edge arrangement on the "open" side of the edges facing away from the point, and resilient applicators for the wire adapted to be pressed by the nail wire during the working stroke of the tool in a direction opposite to the working direction of the tool against the action of a spring and to lift the nail wire from the cutting-off means and stamping means during the return stroke of the tool.

In a second embodiment of the invention the tool comprises two identical tool sections including each a nail wire guide, a cutting-off edge, a wire applicator and a stamping means which are arranged straight opposite each other on those surfaces or ends of the tool sections which face each other and are perpendicular to the direction of motion of the working stroke of the tool, said applicators being adapted during the working stroke to be brought to bear against each other around the nail wire and to be pressed downwards, against the action of a spring means, in the tool frame slidably supporting the applicator, and at the end of the working stroke the cutting-off edges and the stamping means are carried close to each other in order to effect cutting-off and stamping of the nail wire.

In a third embodiment of the invention the stamping means consists of a mandrel having a stamping edge situated in the symmetry plane and generally parallel to the nail wire, top surfaces or top facets inclined obliquely downwardly-outwardly from the edge on either side of the symmetry plane, and side facets adjoining the top facets and arranged further away from the symmetry plane, said side facets having a smaller angle of inclination than have the top facets relative to the symmetry plane and extending down to the end surface of the tool body.

In a fourth embodiment each top facet consists of a generally plane and triangular surface defined by lines between the end points of the stamping edge and a point situated on or immediately above the plane of the end surfaces and between the end points of the stamping edge, while in a fifth embodiment said point is situated on the end surface of the tool body half-way between the end points of the stamping edge.

In a sixth embodiment the top facet, at that portion of it which is remotest from the stamping edge, is defined by a line situated in the end surface of the body, while in a seventh embodiment the side facets at the outer portions of the stamping mandrel are defined by front and back edges which extend between the front end point of the stamping edge and a front point situated on the end surface in the symmetry plane, and respectively between the back end point of the stamping edge and a back point situated on the end surface in the symmetry plane.

In an eighth embodiment said front and back points are situated outside the respective end points of the stamping edge while in a ninth embodiment the top facet has, at that edge of it which is remotest from the stamping edge, a smaller angle of inclination than the angle of inclination of the facet at the stamping edge.

In a tenth embodiment the top facet has a cam which rises above the top facet and extends generally perpendicular to the stamping edge.

In a final embodiment the cutting-off edge has a generally triangular cross-section in order to give the nail a pyramid-shaped point.

The invention will now be described more fully with reference to the accompanying drawings, in which.

Figure 1:
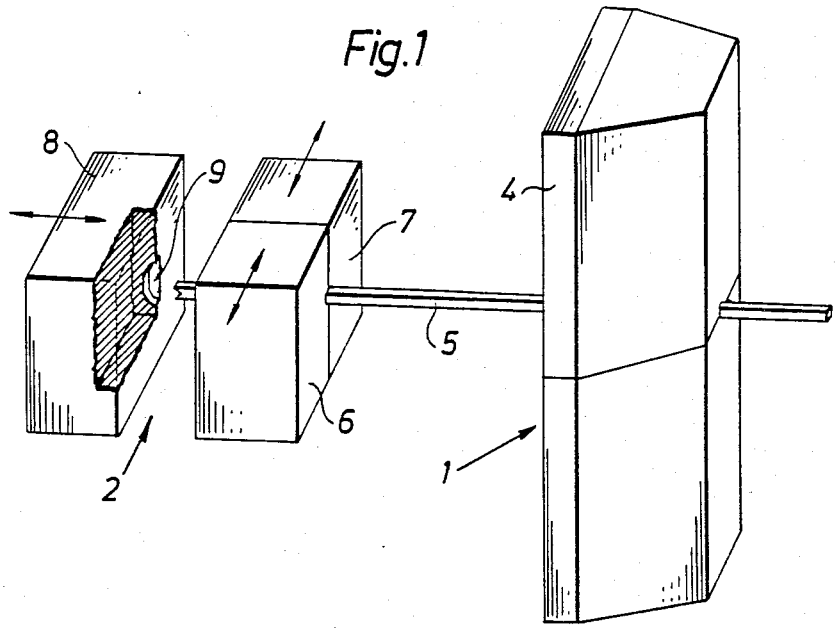
FIG. 1 shows a tool for the manufacture of an expansion nail.

In FIG. 1, 1 represents tool sections 3, 4 for cutting-off and stamping the end of an expansion nail and 2 is a tool for upsetting the end of the nail wire 5 so as to form a head. To this effect the nail wire is clamped by two laterally movable jaws 6 and 7 while a stamp or die 8, which is movable in the longitudinal direction of the nail wire, with a recess 9 upsets the end of the nail wire 5 so as to form a round head.

As the two tool sections 3 and 4 are identical only the lower section 3 is described below with reference to FIG. 2. From this figure it appears that the tool is symmetrical about a vertical plane through line 10. The uppermost surface 11 of the tool sections constitutes an abutment surface and a guide pin 13 and a guide hole 12 situated at the same distance from the symmetry plane. When the tool section 4 is placed on the top of the tool section 3 according to FIG. 1, the guide pin 13 of one tool section coacts with the guide hole 12 of the other tool section and vice versa. In this way the symmetry planes of the tool sections will coincide.

During the manufacture the nail wire is carried through the tool in the symmetry plane. The wire is guided transversely of its longitudinal direction by a guide 14 in the form of a recess, adapted to half the cross-section of the wire, in an applicator plate 15 which is slidably guided by means of rules 16 in guiding means in the body 17 of the tool section 3. The applicator plate 15 has projecting abutments 18 which are pressed against the abutment edge 19 in the body 17 by a spring 20 in the form of a plate of elastomeric material. In this position the applicator plate 15 projects upwards a distance 21 above the abutment surface 11. The bottom of the guide 14, which carries the nail wire 5, lies in this position so high that the wire lies above both the stamping mandrel 30 and the cutting edge 50 which will be described in more detail below.

The spring 20 lies inserted in a groove in the body 17 and is pressed in slightly between the edges 21 of the groove where it is retained. The spring is at its lower part supported by a support 22 which is attached to the body 17 by means of a screw. When the tool sections 3 and 4 are brought together the two applicator plates 15 will first come in contact with each other and the guides 14 grasp the nail wire 5. During the continued movement of the tool the applicator plates are displaced against the action of the spring plate 20 which can expand laterally in the recess 23. The edges 24 of the recess are situated outside the points of the abutments 18 so that the applicator plate 15 can be introduced into the recess 23.

Figure 7:
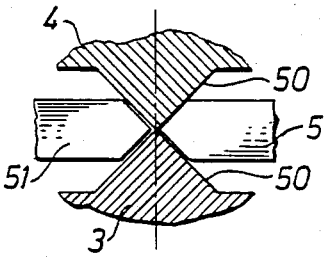
FIG. 7 shows a section through the cutting edges of a double tool at the end of the working stroke.

Symmetrically arranged around the symmetry plane through the line 10 are a stamping mandrel 30 and a cutting-off edge 50. Prior to the working stroke the nail wire 5 is situated immediately above the mandrel 30 and the edge 50. During the working stroke the edges 50 of the two tool sections are brought together so that they will lie quite close to each other or bear against each other at the end of the working stroke, while the nail wire is cut off and ends in a V-shaped point, a so-called chisel cut which, when the cutting edges are straight, takes the form of a wedge. It is advantageous to give the cutting-off edge 50 a triangular cross-section, as is shown in FIG. 7, where also the tool sections 3 and 4 appear as well as the nail wire 5. If the edges 50 are carried out in the mentioned manner the nail will have a pyramid-shaped point 51, which is advantageous within certain fields of use. This shape also contributes to making it easier for the cut-off nail to leave the tool at a high production rate.

As indicated at the tool 2 in FIG. 1, the cut-off end of the nail wire has edges on its sides which have formed during the cutting-off of the point in the tool 1. As the jaws 6 and 7 grasp the nail wire very firmly it is possible to upset an end, cut off in the mentioned manner, so as to form a nail head. This means that during the production no wastage whatsoever will be obtained, which wastage would have to be carried away or might block the function of the tool. This contributes to a rapid and safe production.

Figure 8:
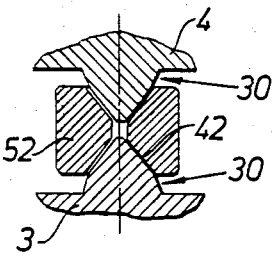
FIG. 8 shows a section through the stamping mandrels of a double tool at the end of the working stroke.

The stamping mandrel 30 has an upper edge 31 which extends in parallel with the line 10 and is situated in the symmetry plane of the tool. The height of the edge 31 above the end surface 25 of the tool section 3 is somewhat smaller than the height of the cutting edge 50 above the end surface 25. This means that the edges 31 of the tool sections 3, 4 are situated at a small distance from each other at the end of the working stroke. This, however, is sufficient to bend out and stamp the expandible portion of the nail and to make a slot in its centre so as not to prevent the expansion of the portion. This is shown in FIG. 8, which will be described in greater detail below.

The stamping mandrel 30 is formed in a specific manner in order to facilitate detachment of the nail wire from the stamping mandrel 30 during the return stroke of the tool. Thus the mandrel has surfaces or facets of generally triangular shape arranged at angles to each other. The facets are preferably symmetrically arranged about the symmetry plane of the tool. For the sake of simplicity only that side of the stamping mandrel 30 which is shown in FIG. 2 is described here. From the edge 31 a top facet 32 extends outwardly-downwardly towards the end surface 25. The facet 32 is defined by substantially straight lines between the end points 33 and 34 of the edge 31 and between these points and a point 36 which is situated on the end surface 25 or slightly above this and preferably half-way between the end points 33 and 34 of the edge 31.

From these points 33 and 34 a front edge 36 and a back edge 37 extend obliquely downwardly-outwardly in the symmetry plane to front and back points 38 and 39, respectively on the end surface 25. A front facet 40 is defined by substantially straight lines between the points 33, 35 and 38 and a back facet is defined in the same way by lines between the points 34, 35 and 39.

The form of the stamping mandrel 30 can be modified. Thus, for instance, one or both the points 38 and 39 may lie straight below the points 33 and 34, respectively. The point 35 may lie closer to the stamping edge 31 so that the facets 40 and 41 meet along a line of intersection with the end surface 25.

Figure 4:
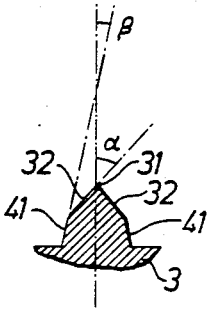
FIGS. 3–6 are sections through a stamping mandrel for an expansion portion of the nail taken along sections III, IV, V and V (with cam) in FIG. 2.
Figure 3:
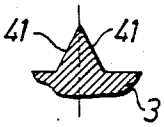

The form of the stamping mandrel 30 is elucidated in FIGS. 3–6 which show sections of the mandrel 30 in planes III, IV, V and V (in a modified form of the mandrel). FIG. 3 shows the triangle-shaped section outside the end points 33 and 34 of the edge 31. FIG. 4 shows a section through a portion of the mandrel 30, which is defined by the top facet 32 and side facets 40 or 41. It appears from the figure that the angle $\alpha$ of the top facet 32 relative to the symmetry plane is greater than the angle $\beta$ of the side facets 40, 41 relative to the same plane. All the sections are perpendicular to the stamping edge 31.

Figure 6:
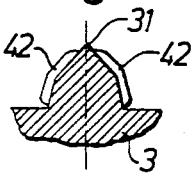
Figure 2:
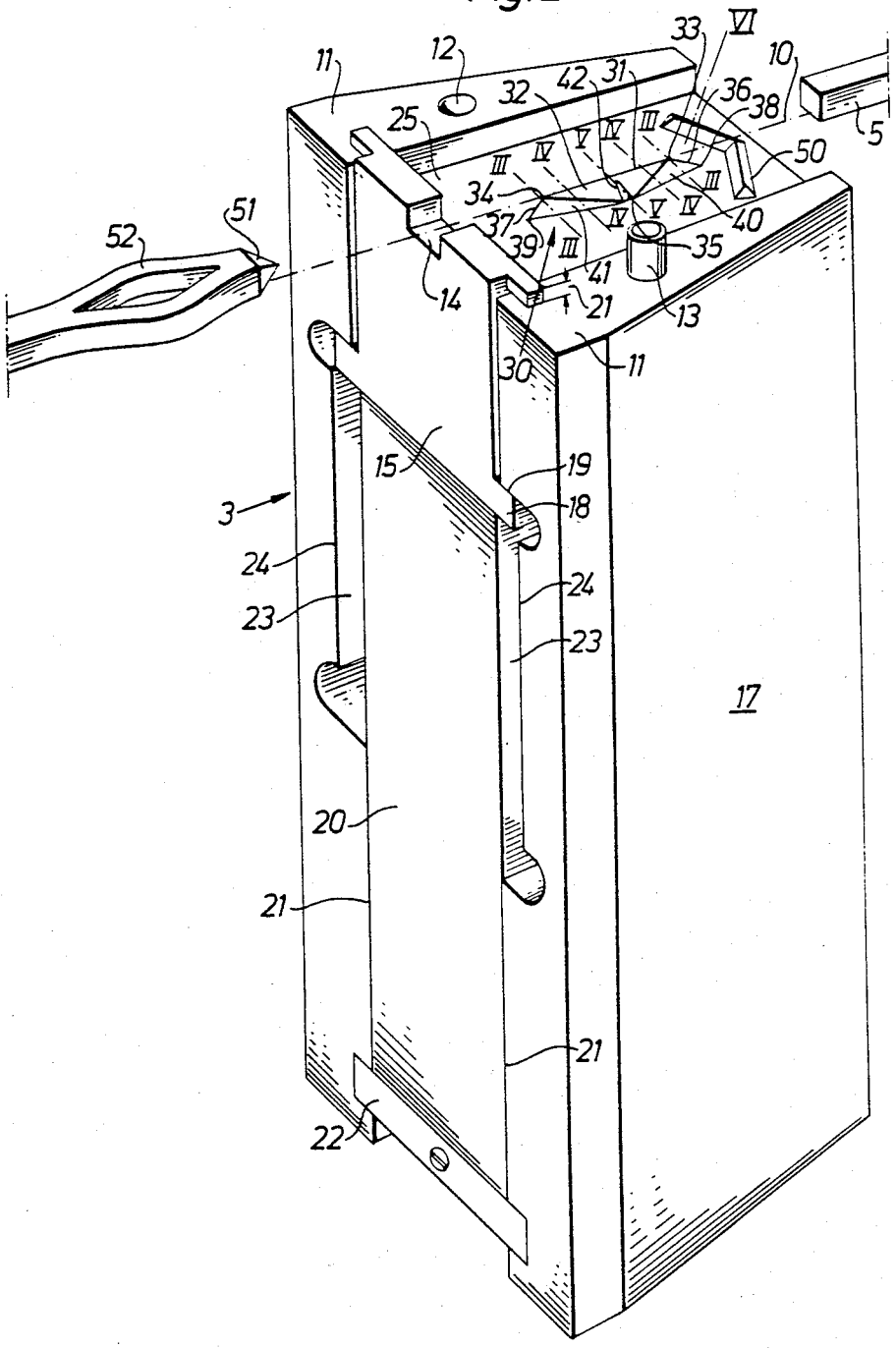
FIG. 2 is a perspective view of a tool according to the invention.

To permit pressing out the expandible portion 52 of the nail (see FIG. 2) somewhat more, the facets are provided with small cams 42 projecting slightly above the facet and extending substantially at right angles to the stamping edge 31, as appears from FIGS. 2, 6 and 8.

Figure 5:
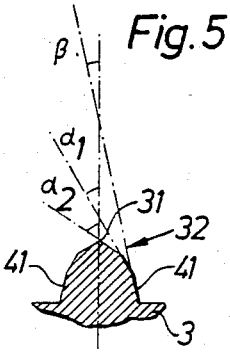

FIG. 5 shows an alternative embodiment of the top facet. In this case the angle $\alpha_2$ to the symmetry plane at the facet portion adjacent the edge 31 is greater than the angle $\alpha_1$ at the facet portion adjacent the side facet 40, 41. This embodiment may be favourable in certain cases in order to detach the nail from the tool very rapidly.

FIG. 7 shows a section through the cutting edges 50 when the tool sections 3 and 4 are in the end position of the working stroke and have cut off the nail wire 5 so that the nail ends in a pyramid-shaped point.

FIG. 8 shows a section through the stamping mandrels 30 when the tool sections 3 and 4 are in the end position of the working stroke and the nail wire 5 has been slit up to obtain the expandible portion 52 shown in FIG. 2.

Some preferred embodiments have been shown and described above to exemplify the invention which, however, can be modified in accordance with other embodiments within the scope of the appended claims.

I claim:

1. A tool for making rivet or expandible nails having a pointed end and a shank portion positioned adjacent to said pointed end and being parted into two outwardly bulging legs spaced apart at the place of maximum bulge with the legs reuniting integrally on each side of the bulging and terminating in said pointed end, said bulging legs defining an expandible eyelet opening in the shank, said tool comprising a frame having two mandrel sections, each mandrel section including an end surface, a guide for the nail positioned adjacent to the end surface, an edge cutting means mounted on the end surface for cutting one end of the nail in V-fashion to shape the point of the nail, eyelet stamping means mounted on the end surface, a resilient applicator positioned adjacent to the end surface and a spring means slidably supporting the resilient applicator and adapted to press the nail during a working stroke in a direction opposite to the working direction of the mandrel sections and to lift the nail from the edge cutting means and eyelet stamping means during the return stroke of the mandrel sections wherein the guide, edge cutting means, eyelet stamping means and resilient applicator are positioned with respect to each mandrel section opposite to each other and are adapted during the working stroke to be brought to bear around the nail and at the end of the working stroke the edge cutting means and the eyelet stamping means are moved toward the respective edge cutting means and eyelet stamping means on the opposed mandrel to effect cutting the nail and stamping the expandible eyelet opening defined by the nail.

2. A tool as claimed in claim 1, wherein the edge cutting means has a generally triangular cross-section to give the nail a pyramid-shaped point.

3. A tool as claimed in claim 1, wherein the eyelet stamping means includes a stamping edge spaced from the end surface of the mandrel having first facets inclined obliquely outwardly from the stamping edge to the end surface o the mandrel on either side of the stamping edge, and second facets extending from the end surface of the mandrel and adjoining the first facets away from the stamping edge, said second facets having a smaller angle of inclination relative to the stamping edge than have the first facets extending to the end surface of the mandrel.

4. A tool as claimed in claim 3, wherein portions of the first facets furthest from the stamping edge are defined by lines situated in the end surface of the mandrel.

5. A tool as claimed in claim 3, wherein the first facets include a cam rising above the stamping edge and extending generally perpendicular to the stamping edge.

6. A tool as claimed in claim 3, wherein each first facet includes a generally plane and triangular surface defined by lines between the end points of the stamping edge and a point situated adjacent the plane of the end surface of the mandrel and between the end points of the stamping edge.

7. A tool as claimed in claim 6, wherein the point situated adjacent the plane of the end surface of the mandrel is situated half-way between the end points of the stamping edge and on the end surface of the mandrel.

8. A tool as claimed in claim 6, wherein portions of the second facets positioned at the end surface of the mandrel are defined by first and second edges extending between one end point of the stamping edge and one point situated on the end surface of the mandrel in a plane perpendicular to the end surface of the mandrel extending through the stamping edge and respectively between the other end point of the stamping edge and another point situated on the end surface of the mandrel in the plane perpendicular to the end surface of the mandrel extending through the stamping edge.

9. A tool as claimed in claim 8, wherein the one and another points in the perpendicular plane extending through the stamping edge are situated on the end surface of the mandrel and beyond the respective end points of the stamping edge.

10. A tool as claimed in claim 9, wherein the edges of the first facets furthest from the stamping edge have a smaller angle of inclination relative to the stamping edge than the angle of inclination of the first facets at the stamping edge.

* * * * *